United States Patent [19]

Girod et al.

[11] 4,388,872

[45] Jun. 21, 1983

[54] RAILWAY CAR BOGIE CONSTRUCTION

[75] Inventors: Hansjochen Girod; Gerhard Korn, both of Mülheim, Fed. Rep. of Germany

[73] Assignee: Thyssen Industrie AG, Fed. Rep. of Germany

[21] Appl. No.: 179,551

[22] Filed: Aug. 19, 1980

[30] Foreign Application Priority Data

Sep. 12, 1979 [DE] Fed. Rep. of Germany ..... 2936771

[51] Int. Cl.[3] ..... B61C 9/44; B61C 9/48

[52] U.S. Cl. ..... 105/99; 105/96; 105/133; 105/179; 105/180

[58] Field of Search ..... 105/97, 136, 179, 180, 105/221 R, 96, 96.1, 99, 171, 133

[56] References Cited

U.S. PATENT DOCUMENTS

| | | | |
|---|---|---|---|
| 1,092,814 | 4/1914 | Kellogg | 105/179 |
| 1,567,972 | 12/1925 | Meehan | 105/97 |
| 1,810,834 | 6/1931 | Klein | 105/113 |
| 2,242,851 | 5/1941 | Flowers | 105/179 |
| 2,439,801 | 4/1948 | Flowers | 105/179 |
| 2,563,338 | 8/1951 | Jonkhoff | 105/179 |
| 2,892,420 | 6/1959 | Cooper | 105/180 X |
| 3,152,557 | 10/1964 | Mueller | 105/96 X |
| 3,661,097 | 5/1972 | Jackson | 105/179 X |
| 3,841,228 | 10/1974 | Hall | 105/108 |
| 4,044,689 | 8/1977 | Eggert, Jr. | 105/221 R |

FOREIGN PATENT DOCUMENTS

| | | | |
|---|---|---|---|
| 13895 | 8/1980 | European Pat. Off. | 105/97 |
| 2549977 | 5/1977 | Fed. Rep. of Germany | 105/97 |
| 46315 | 4/1936 | France | 105/180 |
| 1002726 | 3/1952 | France . | |

*Primary Examiner*—Randolph Reese

*Attorney, Agent, or Firm*—McGlew and Tuttle

[57] ABSTRACT

A bogie for rail cars comprises a traverse which has a portion at each side which extends forwardly and rearwardly and includes a central pin which is engaged in a support box of a half bogie. Each side of the traverse carries a pin which engages in the support box of an associated bogie and the bogie is capable of some vertical and horizontal rotation in respect to the pin. The traverse is supported on springs which extend between the overlying traverse and the underlying bogie at a longitudinally spaced location from the pin. Forward and rear wheel sets are supported in the associated bogies at respective ends thereof and they carry a driving motor therebetween having a planetary gearing which is connected to drive the associated wheels of each set. The bogies are advantageously interconnected by transversely extending tie rods arranged at spaced longitudinal locations in respect to the support pin. The traverse also provides a support for the housing of the rail car and it is provided with a spring at the location of the support and guider connection between the traverse and the car.

4 Claims, 2 Drawing Figures

FIG. 1
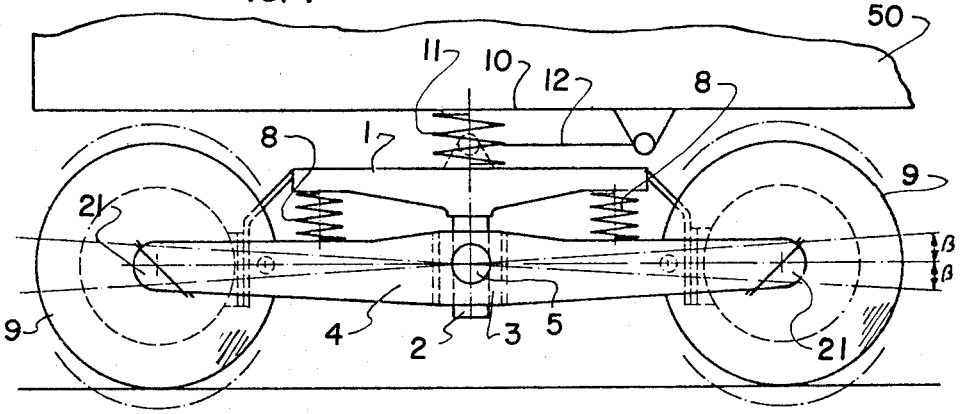
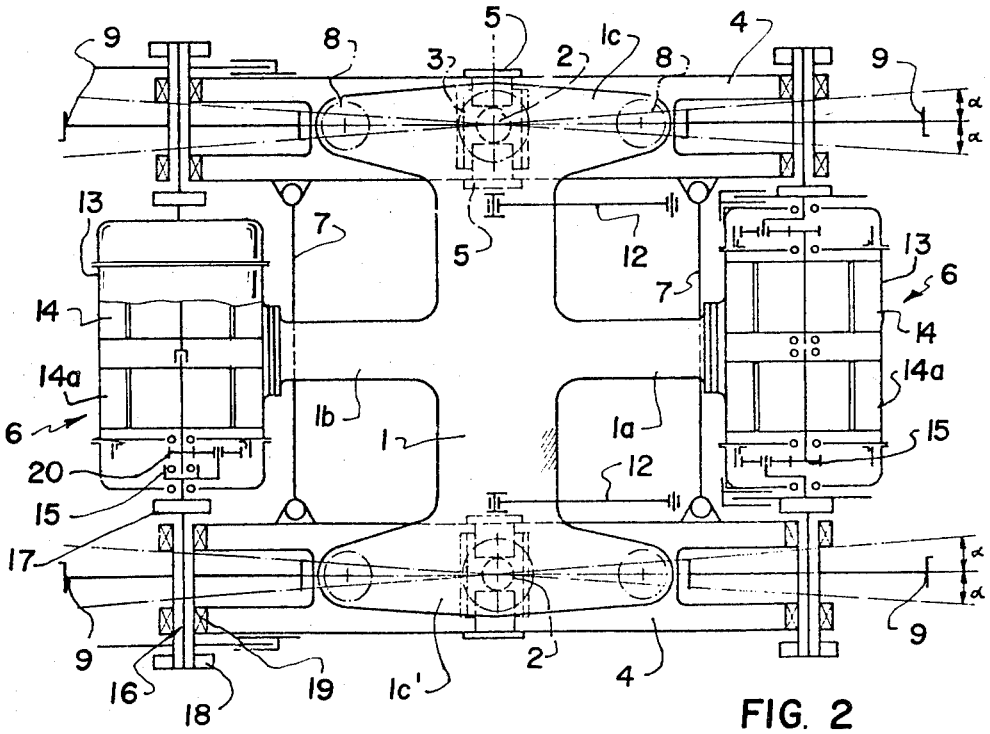
FIG. 2

RAILWAY CAR BOGIE CONSTRUCTION

FIELD AND BACKGROUND OF THE INVENTION

The invention relates in general to vehicle chassis and in particular to a bogie for rail cars such as trolley cars, with a half bogie or cradle frame which is supported in the traverse by vertical pins and is horizontally tiltable and connected by tie bars, and wherein the wheels of each wheel axle are supported independently for each side and are propelled.

It is known that instead of mounting the wheels on rigid connecting axles which cause squeaking in a curve, the wheels are disposed on half axles which are each supported in half bogies, where they are propelled either individually or only on one side. In this case, the half-bogies are supported by vertical pins in the traverse, which pins protect the half-bogies against inclining sideways, however, providing them with the necessary horizontal swing. In addition the half-bogies are kept at distance on both sides of the pin by two tie bars (Journal: Eisenbahn-Technische Rundschau (26) dated Aug. 7, 1977, page 519 picture 8).

Difficulties arise with this construction when the wheels as is required generally are supported in the half-bogies and are intermediately supported by springs. There is easily the danger that the wheels, under the influence of cross-directed forces, at the level of the upper rail edge, are turned in the half-bogies into an inclined position and thereby change the wheel track resulting in a derailment danger. It has been tried to avoid this danger by a forced parallel alignment of the axle tree boxes with the aid of two guide levers, which are connected by a cross-shaft supported at the bogie-frame. It can be realized that these levers have to be heavy and based on the size of the effective forces if a satisfactory effect is to be obtained, which also requires a corresponding space, not to mention the undesirable increase in weight.

SUMMARY OF THE INVENTION

The invention eliminates the disadvantages of the known half bogies with spring supported wheels by employing simple means. The invention provides a bogie with nonspring supported, low as possible masses, which also satisfies the requirements of light construction.

The bogie comprises a traverse which is connected to the half bogies via pins like a cross coupling, and the traverse is supported by spring elements placed on the half bogies on both sides of the pins, and drive units for the wheels are locally fixedly disposed. The cross coupling like support can in principle be disposed both in the half bogie or in the traverse of the bogie. It is more favorable for construction when the vertical pin is solid in the traverse, and the cross coupling is disposed in the half bogie in such fashion that the pin forms a solid part of the traverse and rotatingly and slidingly engages into a vertical box, which is jointedly supported in the half bogie transverse to the direction of vehicle motion.

It is advantageous to have the half bogie made from light metal in order to lower the weight of the masses which are not spring supported.

The drive of the wheels can be provided in various ways. A particularly advantageous construction, wherein also the spring-supported masses are kept small, comprises disposing at the traverse between the wheels of each wheel axis, a motor housing with two rotors independent from each other, which individually drive a wheel via a front side flanged planetary drive and a cardan joint with length equalization as well as two hinge or universal joint couplings.

In order to maintain at the cardan joint a sufficiently large distance of the hinge couplings which provides for the tilting motions of the half bogies, it is advantageous to provide the shaft of the wheels as a hollow shaft and wherein the cardan shaft penetrates the hollow shaft and is connected to the same by a hinge coupling located on the outside of the bogie. For spring supporting of jolts the cardan shaft in addition can be formed as a torsion shaft.

In a further embodiment of the invention it is advantageous that the support bearing of the wheels is vertically separable and in the separation region covered with a cover. This allows disassembly of the wheels without lifting up the vehicle and without removal of the bogies.

As far as the support of the half bogies at the traverse is concerned, the invention can of course also be employed with non-driven so called running bogies.

Accordingly, it is an object of the invention to provide a bogie for rail cars which comprises a traverse which has a pin depending therefrom and with a half bogie on each side of the pin and extending below the traverse, the pin having a central support box into which the pin extends and including means for supporting the traverse for horizontal pivotal and vertical pivotal movement, and further including a tie bar interconnecting the bogies extending transversely, and a wheel having an axle rotatably supported adjacent each end of each bogie, with spring means being disposed between the bogie and the traverse at longitudinally spaced locations at each side of the support pin, wherein each wheel or at least one of them is driven by a drive connected to the wheels to drive them.

A further object of the invention is to provide a bogie for rail cars which is simple in design, rugged in construction and economical to manufacture.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which preferred embodiments of the invention are illustrated.

BRIEF DESCRIPTION OF THE DRAWINGS

In the Drawings

FIG. 1 is a partial side elevational view of a rail car having a bogie constructed in accordance with the invention; and FIG. 2 is a partial top plan view of the bogie shown in FIG. 1.

DESCRIPTION OF THE PREFERRED EMBODIMENTS

Referring to the drawings in particular the invention embodied therein comprises a rail car 50 which is supported on a truck or bogie assembly which includes a traverse 1 having a forwardly extending and rearwardly extending portion 1*a* and 1*b* respectively which carry at their extreme ends drive units 6 of substantially the same character. In accordance with the invention the car body 50 is supported on a spring 11 which is centered on the top of the traverse 1 and in addition a rigid guider connection 12 between the traverse 1 and the car housing 50 ensures the proper interconnection of the two parts during travel movement.

The truck assembly includes a half bogie 4, 4 arranged to underline respective side parts 1*c*, 1*c'* of the traverse. Spring members 8 are interposed between the ends of the side parts 1*c* and 1*c'* and the associated bogies 4, 4.

The traverse 1 of the bogie is provided with vertically downward running pins 2 on each side. The respective pins 2,2 engage a support box 3, 3 which are hinge mounted in the middle of half bogie 4,4 disposed transverse to the direction of motion of a vehicle 50. Two bolts 5,5 engage in the boxes 3 of each half bogie from each side. By this cardan or universal joint support the half bogies 4 can rotate in addition to moving in a horizontal tilting motion around the pin 2 through an angle alpha. The bogies can also move with a vertical tilting motion around the bolt 5 through an angle beta. In order that the horizontal tilting motion, which occurs when passing curves, is the same with both half bogies 4, these are connected with each other with two tie bars 7.

Between the traverse 1 and the half bogies 4 in the direction of vehicle motion on both sides of the pins 2 are disposed spiral springs 8 which cushion the tilting motions occuring when passing rail unevennesses. This arrangement substitutes for conventionally individual spring support of the wheels 9, so that the wheels can be solidly supported in the half bogies 4. The wheel bearings are vertically partitioned in order to allow for demounting of the wheels 9 without having to lift up the car.

The parting region of the bearing parts is covered with a cover 21. On the traverse 1 the car casing or case 10 is supported on both sides with additional or secondary springs 11, 11 each of which can also be an air or hydraulic spring. Guiders 12 on the side serve to maintain the car case 10 relative to the drive and braking forces. Located in the middle line of each set of opposite wheels there is a motor housing 13 at each end of the traverse 1 which forms a drive unit 6. Two independent runners 14 and 14*a* are located in the motor housing 13 and within each motor case there is a frontside flange mounted planetary drive 15. Cardan shafts 16,16 start from the planetary drive 15 and have lengths equalization so as to drive the wheels 9 via intermediate hinge or universal joint couplings 17. In order to obtain a hinge distance as large as possible for equalizing the swings of the half bogies 4 at the cardan shafts 16, 16 the shafts of the wheels 9 are formed as hollow shafts 19 wherein the cardan shaft 16 penetrates the hollow shaft 19 and is connected with the same by a hinge or universal joint coupling 18 located on the outside of the half bogie. Each cardan shaft 16 is formed as a torsion shaft. On the right side of FIG. 2 the motor runners 14 and 14*a* are disposed on both sides and are grease lubricated supported. On the left side, on the other hand, the runners 14 and 14*a* are free on the drive shaft 20 of the planetary drive 15. The last mentioned construction has the advantage that the runner shaft can be supported in oil lubricated bearings and therefore higher rotation speeds are obtainable compared with the usual support in grease lubricated bearings.

While specific embodiments of the invention have been shown and described in detail to illustrate the application of the principles of the invention, it will be understood that the invention may be embodied otherwise without departing from such principles.

What is claimed is:

1. A bogie for rail cars, comprising:

a traverse having two spaced-apart support pins depending therefrom and formed integrally therewith;

a half bogie on each side of and below said traverse;

each half bogie having a support box into which one of said pins extends;

a pair of bolts connected to each half bogie and extending into each support box, each pair of bolts engaging one of said pins for horizontal pivotal motion and vertical pivotal motion of each of said support boxes and half bogies with respect to each of said pins and said traverse;

a tie bar interconnecting said half bogies on respective opposite sides of said traverse;

a wheel having an axle rotatably supported adjacent each end of each bogie;

spring means disposed between said traverse and each of said half bogies at spaced locations on each side of each of said pins for facilitating spring support of said traverse by said half bogies and said wheels;

said traverse having a central portion extending between said half bogies; and a drive motor connected at each end of said central portion of said traverse for driving said wheels, each drive motor including two mutually independent runners, a slide flange mounted planetary gear arranged on each side of said drive motor and driven by said runners, a cardan shaft, said wheels each having an axle connected to one cardan shaft, each cardan shaft being pivotal to one of said half bogies and adjustable in length.

2. A bogie according to claim 1, including a hollow shaft supporting each of said wheels on each half bogie, one of said cardan shafts arranged within each of said hollow shafts and connected to each hollow shaft by a hinge coupling, each hollow shaft driven by said drive motor, said hinge coupling being provided on an outside of each half bogie.

3. A bogie according to claim 2 including a hinge coupling connecting said cardan shaft to said drive motor.

4. A bogie according to claim 3 wherein said cardan shaft is formed as a torsion shaft.

* * * * *